US008047546B1

(12) United States Patent
Klein

(10) Patent No.: US 8,047,546 B1
(45) Date of Patent: Nov. 1, 2011

(54) MULTI-TARGET CLAMPING ASSEMBLY

(75) Inventor: Joshua James Klein, Shoreview, MN (US)

(73) Assignee: Meggitt Training Systems, Inc., Suwanee, GA (US)

( * ) Notice: Subject to any disclaimer, the term of this patent is extended or adjusted under 35 U.S.C. 154(b) by 1023 days.

(21) Appl. No.: 11/854,149

(22) Filed: Sep. 12, 2007

Related U.S. Application Data

(60) Provisional application No. 60/953,465, filed on Aug. 1, 2007.

(51) Int. Cl.
*F41J 7/00* (2006.01)

(52) U.S. Cl. ..... 273/406; 273/392

(58) Field of Classification Search ..... 248/121, 248/346.03, 346.06, 473; 273/348, 369, 273/372, 378, 403, 404, 407, 409
See application file for complete search history.

(56) References Cited

U.S. PATENT DOCUMENTS 3,034,788 A * 5/1962 Cauble ..... 273/408
3,392,980 A * 7/1968 Ortega ..... 273/406
3,516,670 A * 6/1970 Brieff et al. ..... 273/372
4,249,743 A * 2/1981 Lee ..... 273/391
5,145,133 A 9/1992 France
5,211,404 A 5/1993 Grant
5,240,258 A * 8/1993 Bateman ..... 273/392
6,994,347 B2 * 2/2006 Tessel et al. ..... 273/373
7,694,973 B1 * 4/2010 Hofmeister et al. ..... 273/406

* cited by examiner

*Primary Examiner* — Gwendolyn Baxter
(74) *Attorney, Agent, or Firm* — Smith Gambrell & Russell LLP

(57) ABSTRACT

A target holder assembly for interchangeably supporting a two-dimensional target and a three-dimensional target includes an enclosure and a target holder frame connected to the enclosure, the target holder frame including a cross arm member connected between two target arms. The cross arm has a base length with clamping members extending from both ends of the base length to engage three dimensional targets. The cross arm also has receiving grooves proximate the junction of the clamping members and the base length positioned to engage the two-dimensional targets. A front protrusion is positioned along the base length to engage either the two-dimensional target or the three-dimensional target. The holder assembly further includes a clamping apparatus connected to the base length to engage either the two-dimensional target or the three-dimensional target.

7 Claims, 11 Drawing Sheets

22
14
52
24l
24
32
17
26
50
15
11
16l
16b 32
16t
18
24r
20

MULTI-TARGET CLAMPING ASSEMBLY

CROSS REFERENCE TO RELATED PATENT APPLICATIONS

This non-provisional patent application claims priority from provisional patent application No. 60/953,465, filed on Aug. 1, 2007, said application relied upon and incorporated herein by reference.

FIELD OF THE INVENTION

The present invention relates generally to a target clamping device.

BACKGROUND OF THE INVENTION

A variety of target clamps are used to support targets for live action training. One clamp utilizes a simple pinching action accomplished by utilizing the mechanical advantage of an inclined plane in the form of a screw. It allows the user to place any target that fits between the jaws of the target holder and then clamp it in. The shape of the target near the target head is then defined by the target head. Another concept also utilizes mounting holes corresponding to the Department of Defense target system. It holds the target in place with two hooks and a screw through the front cutout of the target. The target has to be put on to the head with a tool in order for it to snap onto the hooks. The method used to hold the FIG. 11 style target is generally four large thumb screws that clamp the target at each of the slots at the lower portion of the target.

While these target clamps are able to secure a specific stationary infantry target designed for the clamp, they fail to hold more than one type of target, which limits the user to a single stationary infantry target to be used.

DETAILED DESCRIPTION OF THE INVENTION

Figures 1, 2:
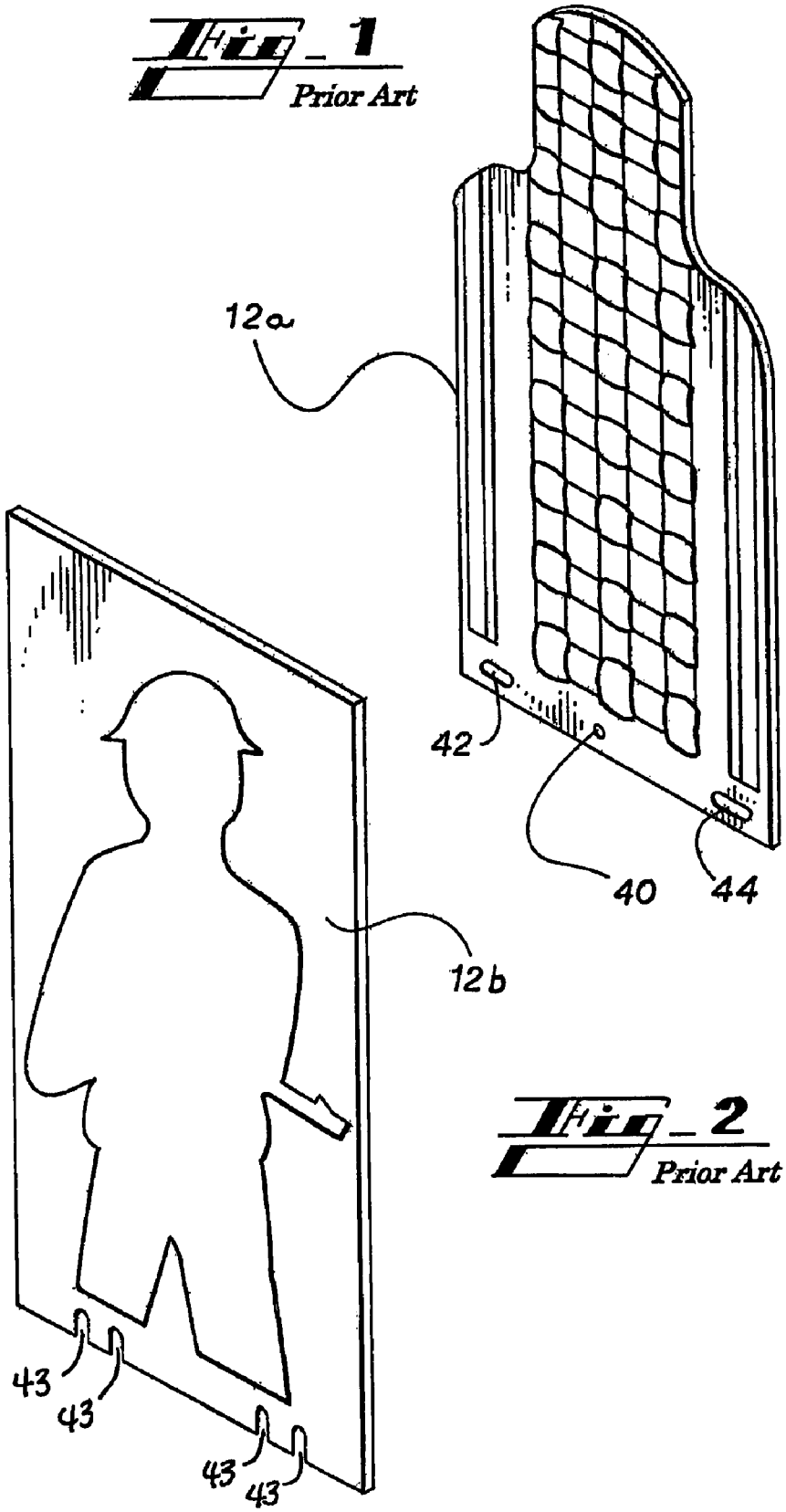
Fig 1 Prior Art
Fig 2 Prior Art
FIG. 1 is a perspective view of a two-dimensional stationary infantry target known in the art as a "waffle target" or an "B-target"
FIG. 2 is a perspective view of a second two-dimensional stationary infantry target known in the art as a FIG. 11 target.
Figure 3:
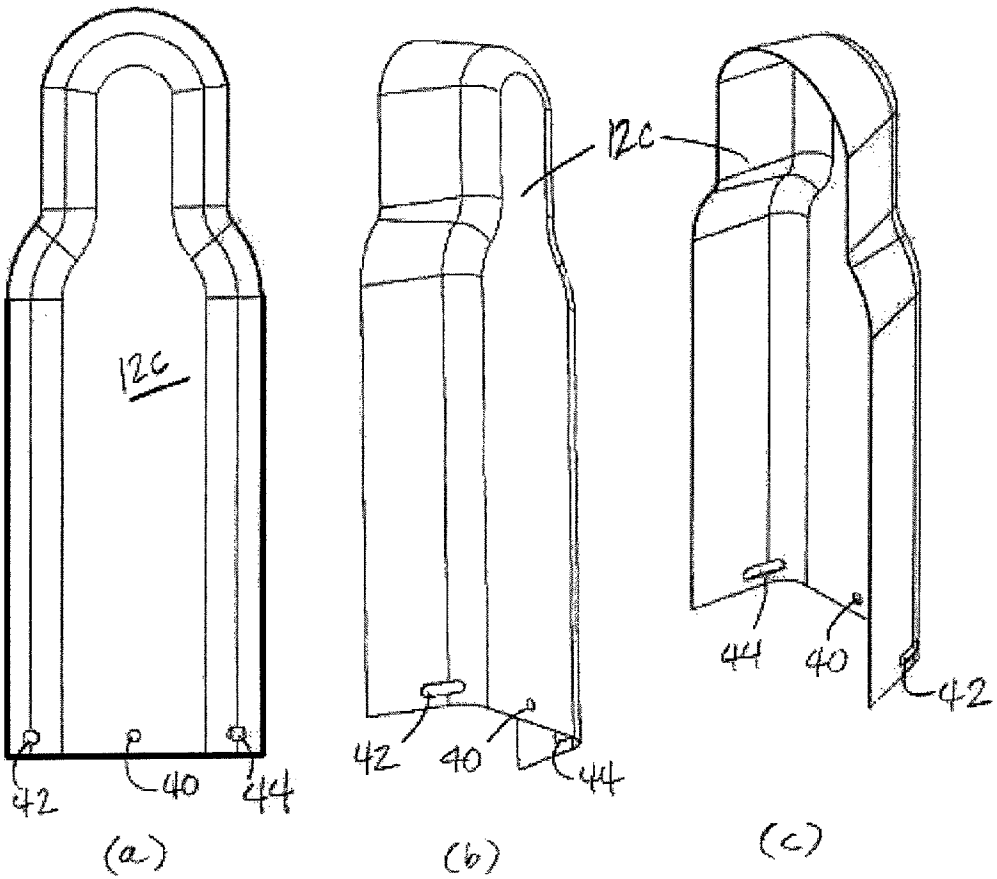
Fig. 3 (Prior Art)
FIGS. 3*a*-3*c* are views of a three-dimensional stationary infantry target.

Referring to the drawings, a target clamp assembly 10 is illustrated that is able to securely support a variety of stationary infantry targets 12 for use at a firing range. As a result, the target clamp assembly 10 allows a range master to choose from the various different types of targets 12, namely, two-dimensional or three-dimensional targets, to present to the user. For example, the target clamp assembly 10 allows the user to select a substantially two-dimensional target 12*a*, such as an "E-Target" (as shown in FIG. 1) or FIG. 11 style target 12*b* (as shown in FIG. 2), or a three-dimensional target 12*c* (as shown in FIG. 3). The two-dimensional E-Target target 12*a* is typically a 0.07-inch thick high-density polyethylene target with waffles and ridges to provide rigidity. The FIG. 11 target is typically made from 0.07-inch thick aluminum. The three-dimensional target 12*c* includes those known as "Fat Ivan," and it is typically a vacuum formed, approximately 0.1 inch thick high-density polyethylene target. Two of these targets 12 have three standard apertures: a central hole or aperture 40 having a diameter of approximately 0.72 inches, with the center of the aperture 40 being approximately 1.15 inches from the bottom edge of the target 12, and distal apertures 42, 44 on opposite sides of the central aperture 40 (see FIG. 1 and FIG. 3). Looking to FIG. 2, another target 12*b* has four slots 43 along the lower edge of the target 12*b*, with the width of each slot being approximately 0.5 inches and the height being approximately 1.5 inches.

Figure 9:
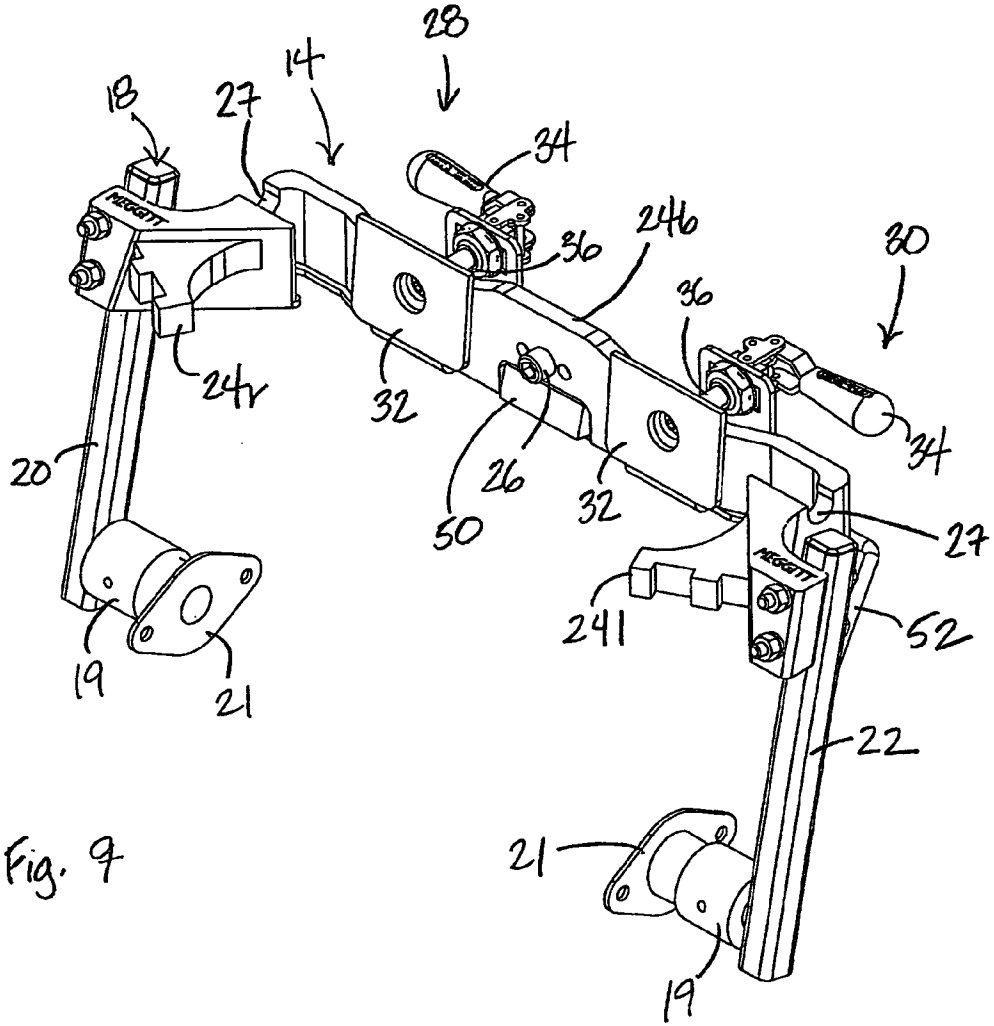
FIG. 9 is a perspective view of the target holder of the target clamp assembly.
Figure 10:
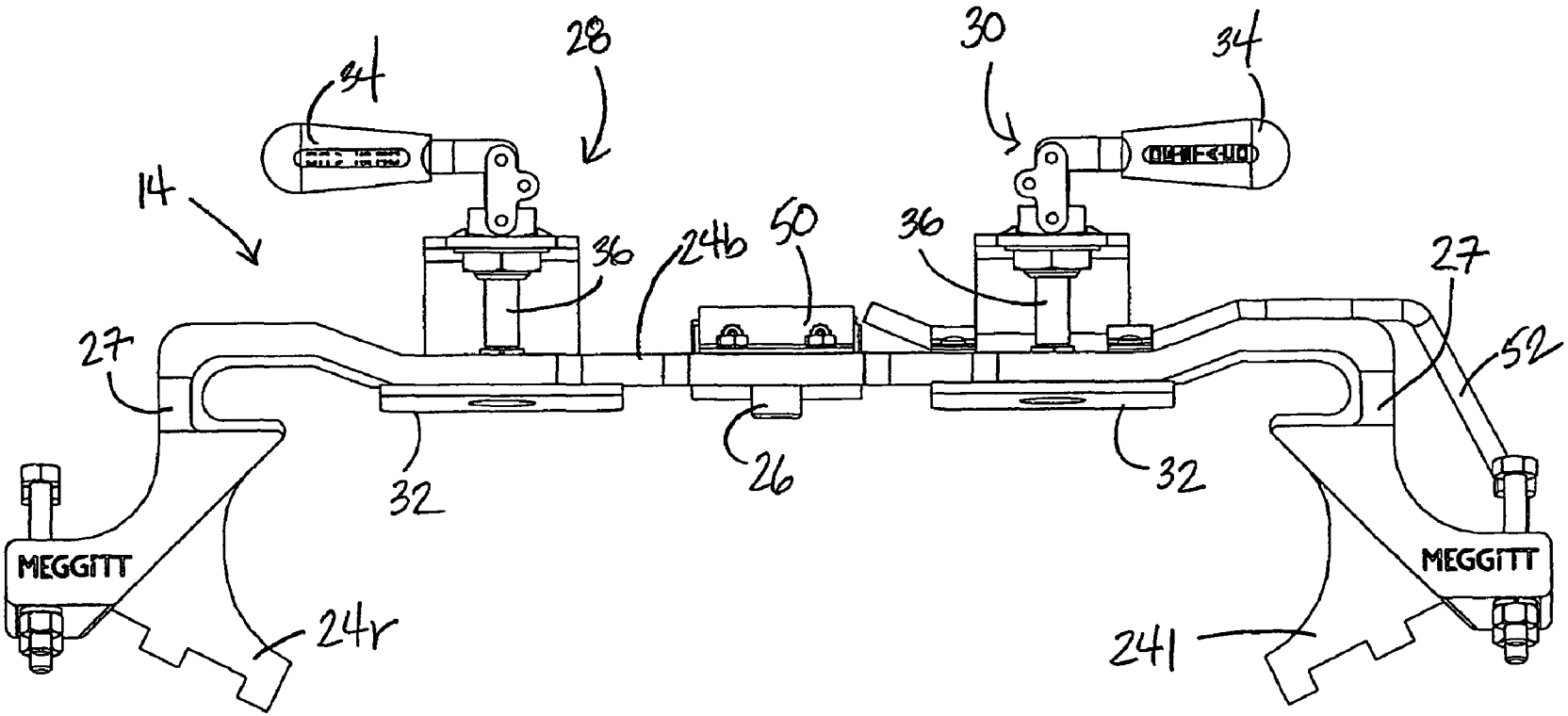
FIG. 10 is a top plan view of the target holder illustrated in FIG. 9.

The target clamp assembly 10 includes a target holder 14 that is secured to a target presentation device or base member 16. The target holder 14 includes a frame 18 for rigidly supporting both the three-dimensional target 12*c* and also the two-dimensional E-target 12*b* by utilizing cutouts in the respective target 12 (as predefined in each target 12 according to set guidelines). The frame 18 includes two arms 20, 22 that support a cross arm member 24 connected between the two tube arms 20, 22. The two arms 20, 22 are connected to the base member 16 using mount bearings 21 that are affixed to the target presentation device 16 and cylindrical arms 19 that are connected to the two tube arms 20, 22 (see FIG. 9). This connection allows the tube arms 20, 22 to be rotated about the target presentation device 16 as may be desired by the user. The cross arm member 24 has a base length 24*b*, with clamp ends 24*l*, 24*r* extending from opposite ends of the base length 24*b* to act as two protrusions to engage three dimensional targets 12*c*, such as the one illustrated in FIG. 3. The clamp ends 24*l*, 24*r* are substantially hook shaped, such that the cross arm member 24 has a substantially C-shaped appearance (see FIG. 10). The clamp ends 24*l*, 24*r* are connected to the cross arm base 24 to provide a positive hold on the target 12, and act as cantilevered jaws extending from the base length 24*b*.

Figure 4:
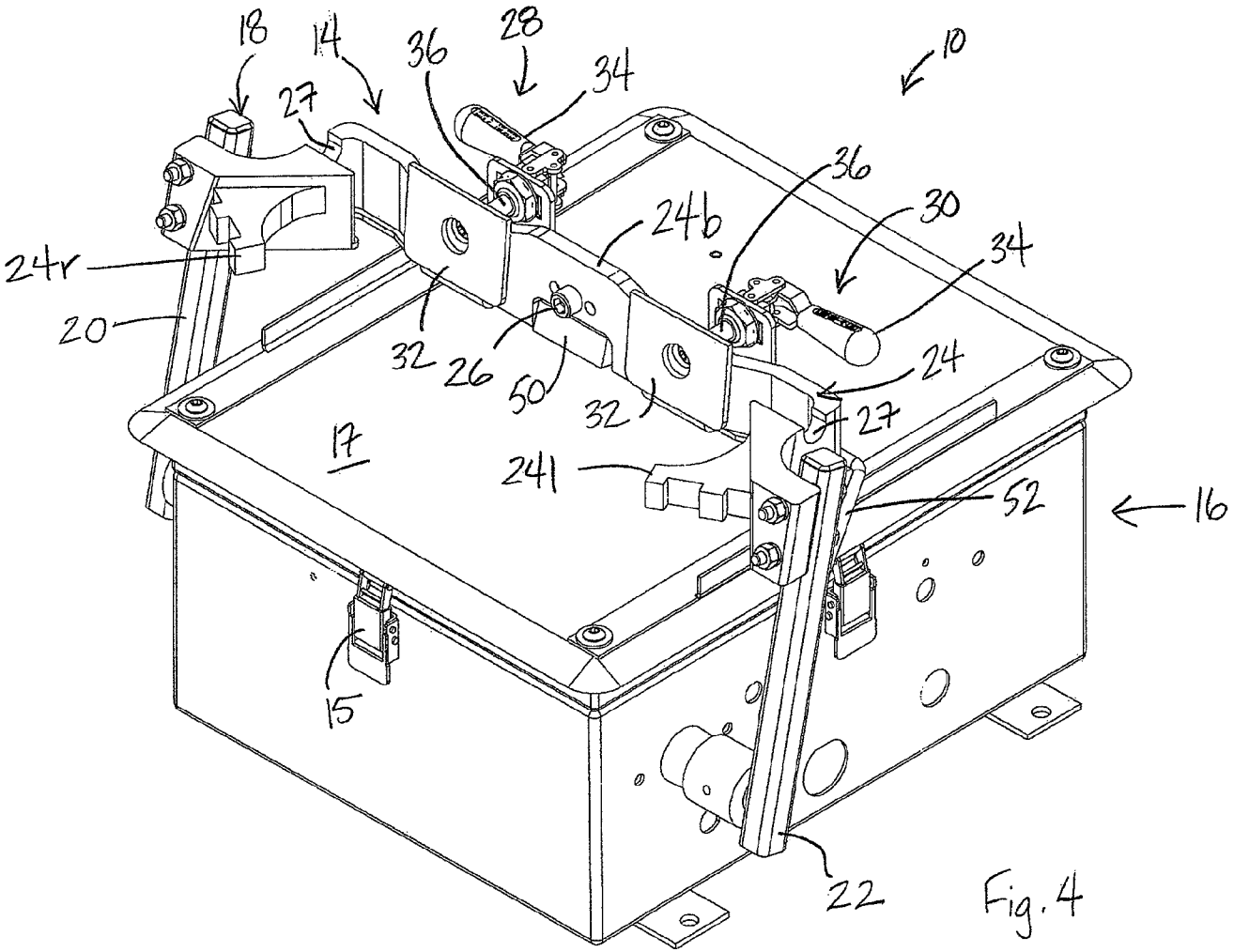
FIG. 4 is a perspective view of a target clamp assembly mounted to a target presentation device used to hold the various targets illustrated in FIGS. 1-3.
Figure 5:
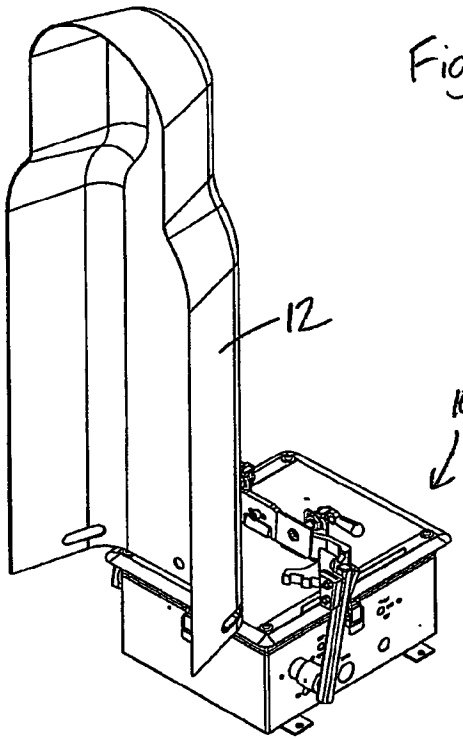
FIG. 5 is a perspective view of three-dimensional target as illustrated in FIG. 3 in proximity of the target clamp assembly mounted to a target presentation device as illustrated in FIG. 4.
Figure 6:
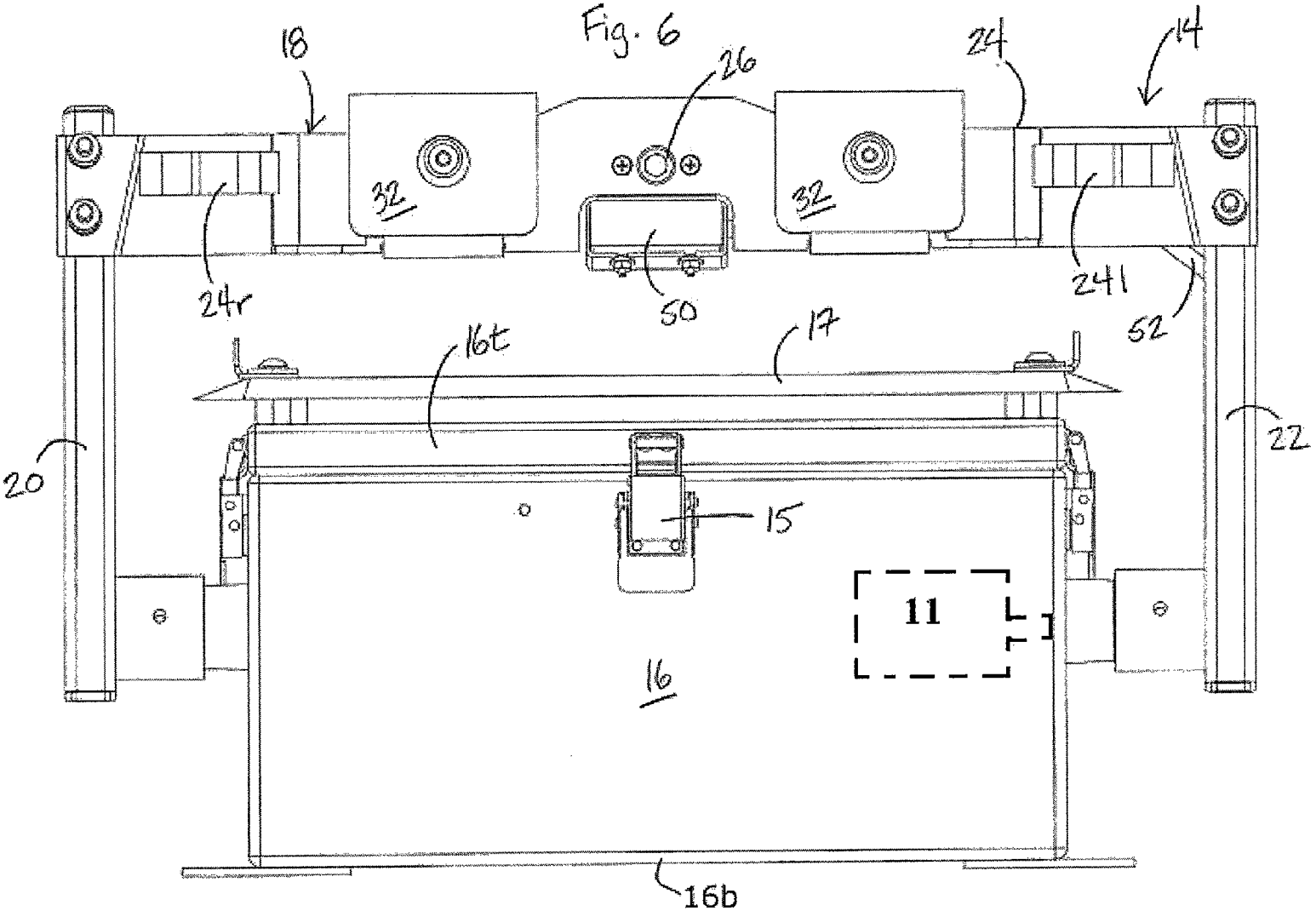
FIG. 6 is a front elevational view of the target clamp assembly illustrated in FIG. 4.
Figure 7:
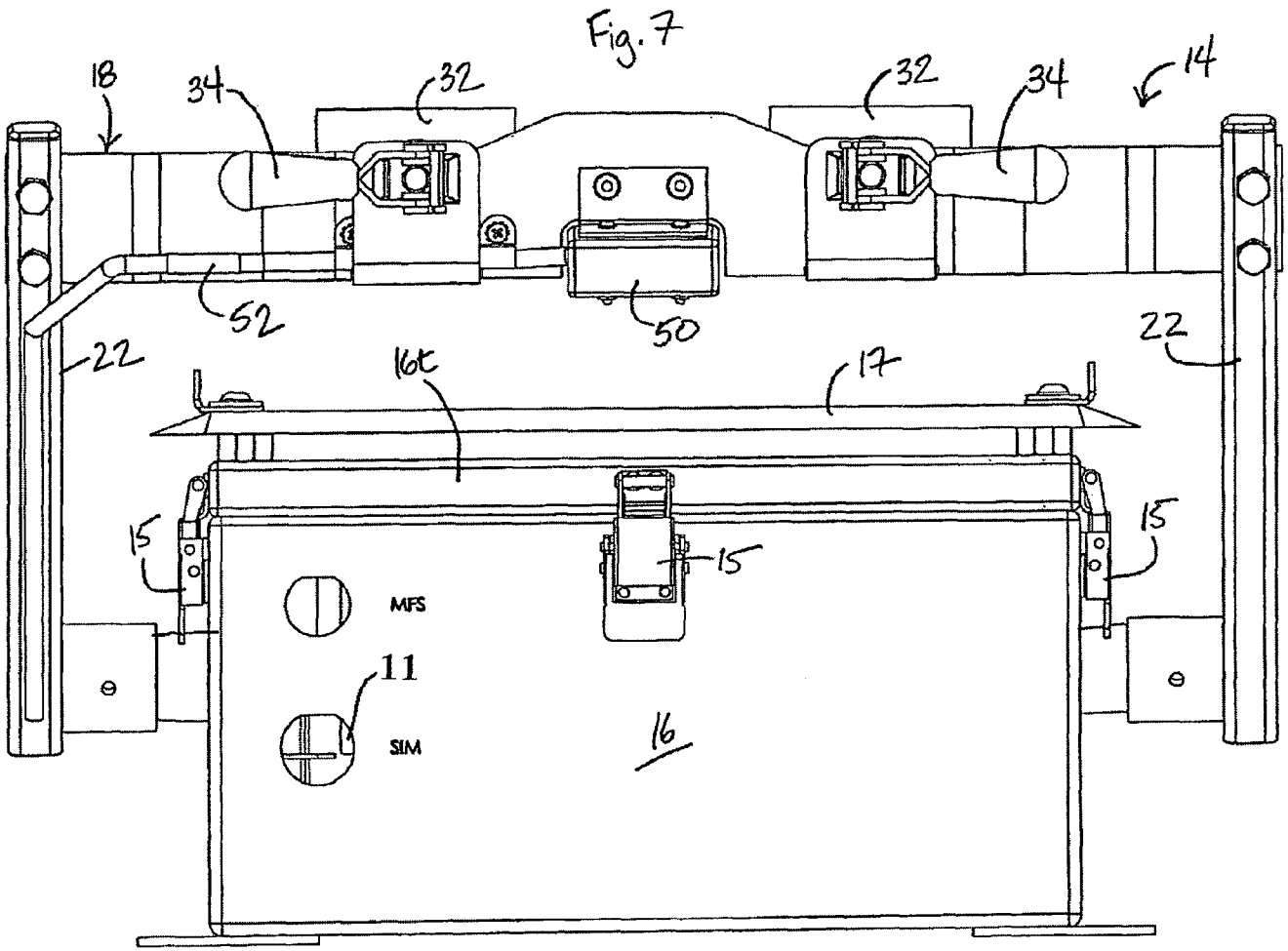
FIG. 7 is a rear elevational view of the target clamp assembly illustrated in FIG. 4.
Figure 8:
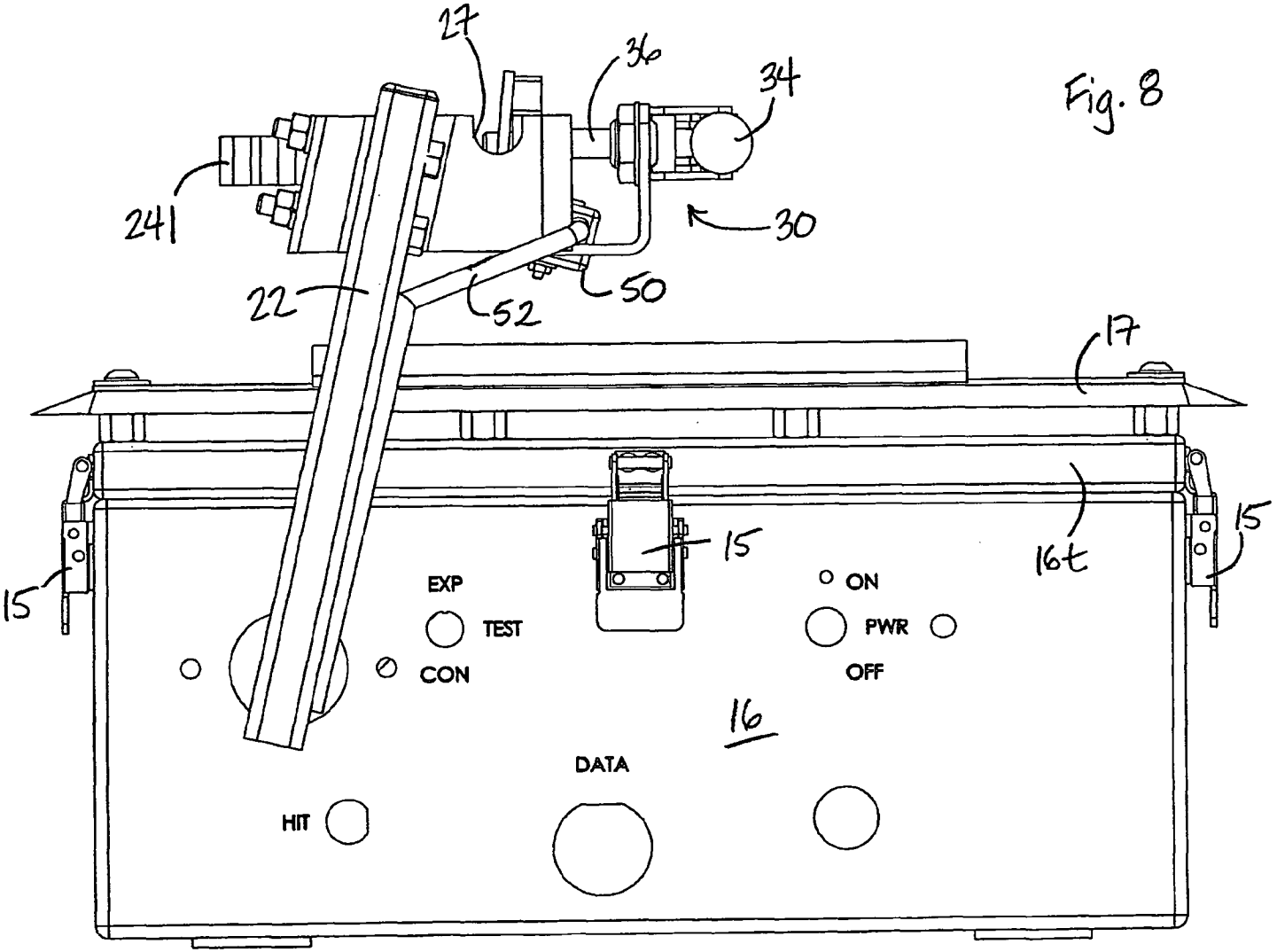
FIG. 8 is a side elevational view of the target clamp assembly illustrated in FIG. 4.

The cross arm member 24 also includes a third or front protrusion 26. In the embodiment illustrated in FIG. 4, the third protrusion 26 is substantially centrally located along the base length 24*b* of the cross arm member 24. The front protrusion 26 is used to engage the central aperture 40 of the target 12. In particular, the protrusion 26 is round and has a smaller diameter then that of the round cutout 40 in the middle of the targets 12.

In the embodiment illustrated in FIGS. 4-12, a pair of straight action over-center articulated clamps 28, 30 engage the base length 24*b* of the cross arm member 24. The clamps 28, 30 each include a clamping plate 32 that is connected to a locking handle 34 by a central connector 36. Rotation of the locking handle 34 will force a corresponding movement by the clamping plate 32 either toward or away from the cross arm 24*b*. This action will therefore either pull on the target 12 to apply a tension on the target 12 between the two rear protrusions 24*l*, 24*r* and the clamps 28, 30, or loosen the tension on the target 12 to remove and replace the target 12.

Looking to FIGS. 4-9, the target presentation device or enclosure 16 includes a base or housing 16*b* with an enclosure top 16*t* attached thereto. The enclosure top 16*t* is secured to the base 16*b* via a series of latches 15. Furthermore, a shield 17 is connected to the base, with the shield 17 being offset from the enclosure top 16*t* via a series of bolts or similar means.

In operation, the user will move the adjust the locking handle 34 of the clamps 28, 30 so that the clamping plates 32 are slid into an open position. The user will then position the target 12 so that the front protrusion 26 traverses the central aperture 40 or engages the target 12 itself. The distal apertures 42, 44 or slots 43 are then placed about the respective two rear protrusions 24*l*, 24*r* of the target 12. The user will then adjust the locking handle 34 of the clamps 28, 30 to draw the clamping plates 32 toward the cross arm 24*b* to thereby secure the target 12 to the target holder 14. By the time the target 12 is engaged by the clamping plates 32, a hit sensor 50 will engage the target 12 for a central processor 11 to monitor the target 12 as discussed below.

Figure 11:
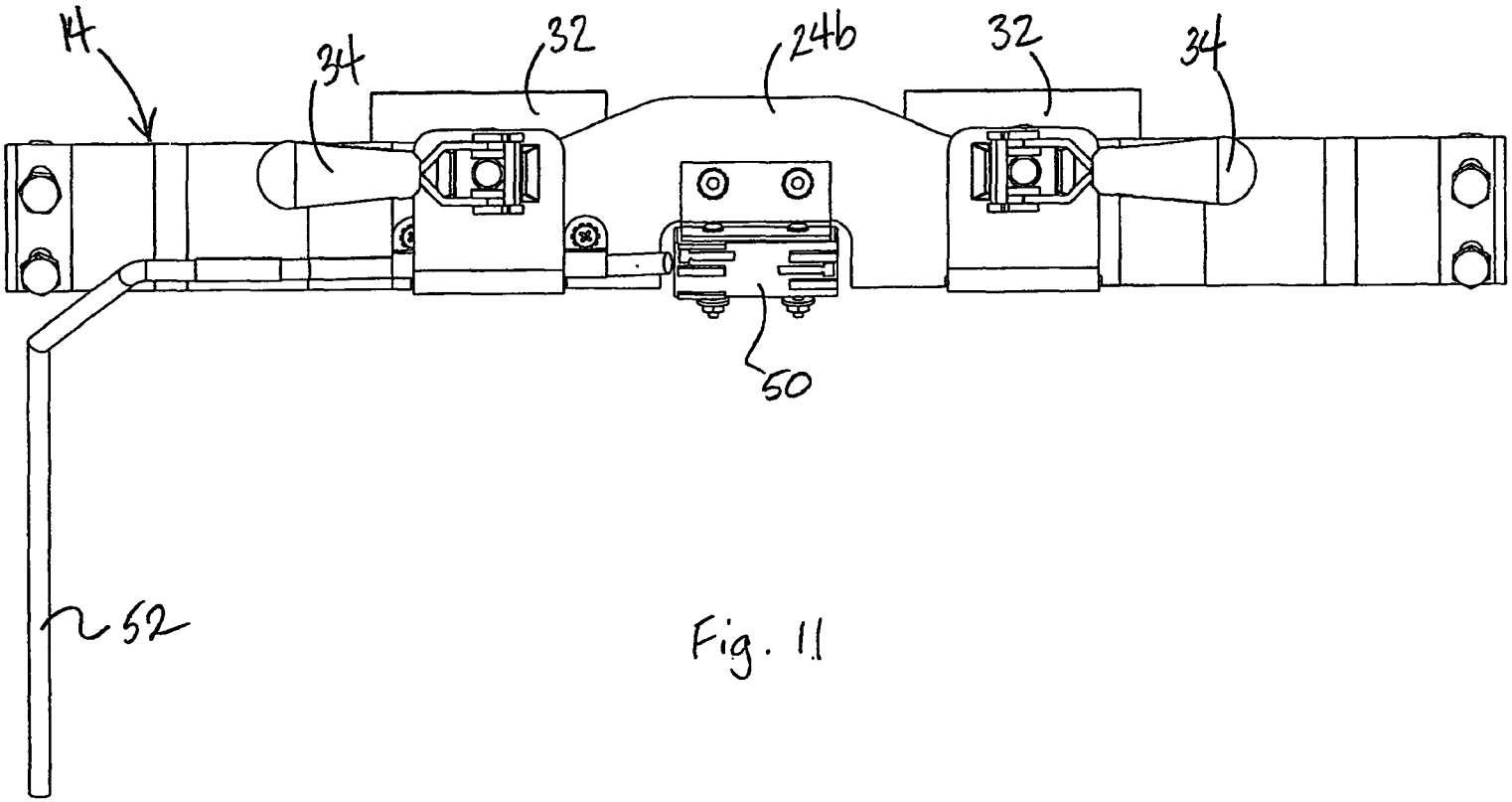
FIG. 11 is a front elevational view of the target holder illustrated in FIG. 9.
Figure 12:
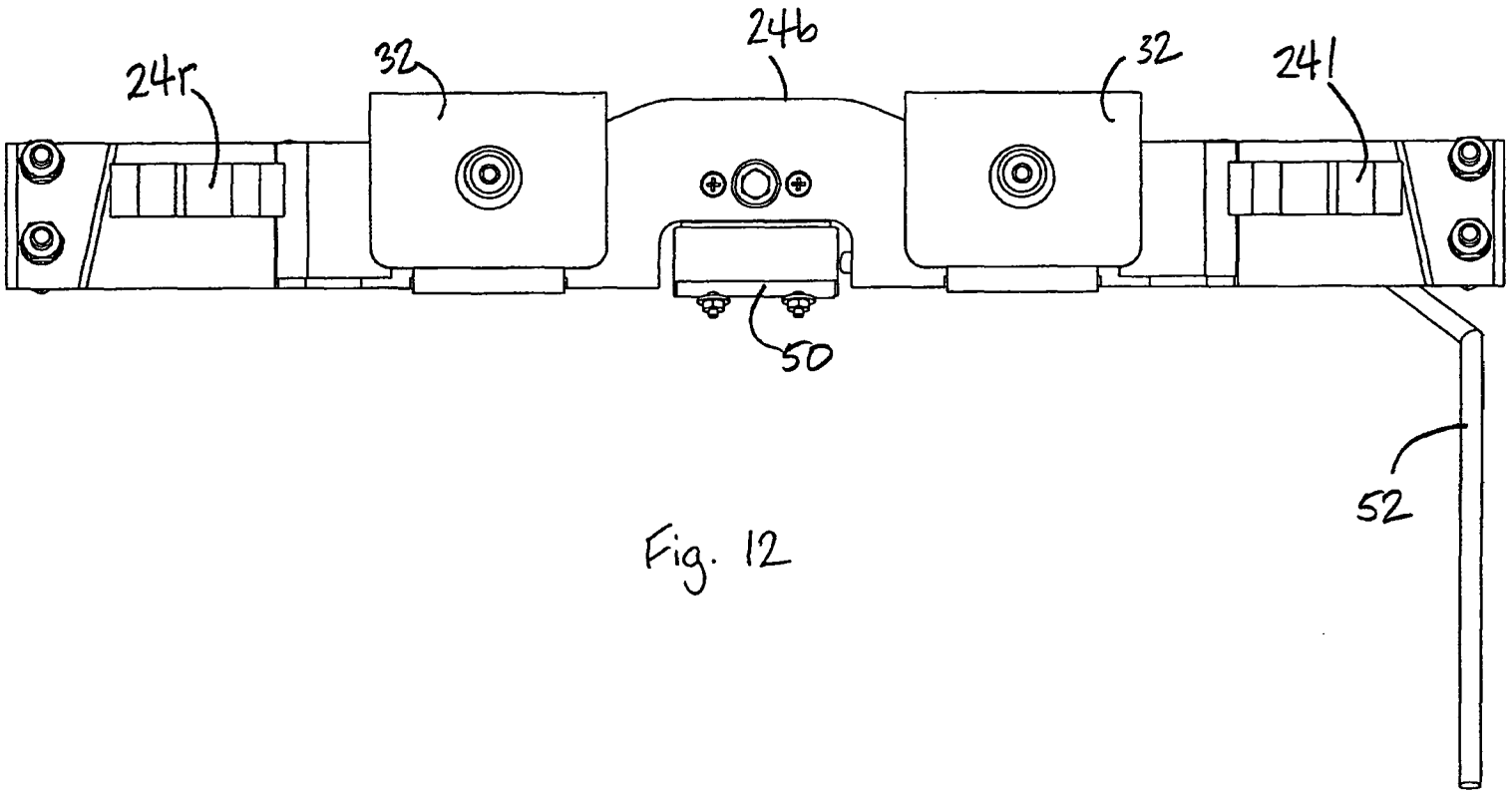
FIG. 12 is a rear elevational view of the target holder illustrated in FIG. 9.

The target holder assembly 10 utilizes a different method to support two dimensional targets 12, such as FIG. 11 targets 12*b* illustrated in FIG. 2. In particular, a pair of receiving grooves 27 are formed in the cross arm member 24. In this embodiment, the two-dimensional target 12 is slid into curved receiving grooves 27 on opposite sides of the frame 18, and the front protrusion 26 must be removed to allow the target to contact the hit sensor 50. The target 12 is held in place by pinching it between the frame 18 of the target holder assembly 10 and the same clamps plates utilized for the other targets 12.

In operation, the user will move the adjust the locking handle 34 of the clamps 28, 30 so that the clamping plates 32 are slid into an open position. The user will then position the target 12 so that the front protrusion 26 traverses the central aperture 40. At substantially the same time, the target 12 will slide into the receiving grooves 27. The user will then adjust the locking handle 34 of the clamps 28, 30 to draw the clamping plates 32 toward the cross arm 24*b* to thereby secure the target 12 to the target holder 14. By the time the target 12 is engaged by the clamping plates 32, the hit sensor 50 will engage the target 12 for the central processor 11 to monitor the target 12 as discussed below.

As previously noted, a hit sensor 50 may additionally be attached to the cross arm member 24. The hit sensor 50 will engage the target 12 when the target 12 is drawn toward the cross arm member 24 to engage the third protrusion 26 into the middle cutout of the target 12. The hit sensor 50 is able to monitor the status of the target 12 during use and generates a corresponding signal. The hit sensor 50 is connected to the central processor 11, which is a type known in the art. The central processor 11 may be housed in the enclosure or base member 16 and connected to the hit sensor 50 via an electrical connection that may be made through conduit 52.

The target holder 14 can be attached to a stationary infantry target (SIT) enclosure for the target presentation device 16 to hold the targets 12. Various targets 12 that can be buttressed by the target holder assembly 10 include, but are not limited to, the 3D Personnel Target NSN 6920-01-164-9625, plastic E-Target NSN 6920-00-071-4780, and any other target having mounting holes corresponding with the Department of Defense target system featured on the two aforementioned targets. Another target 12 that can be held is the Ministry of Defense FIG. 11/59 target NH/6920-99-792-394-2, and likewise targets 12 having the same mounting features.

No tools are needed to change the target 12, and the replacement of targets 12 can be performed quickly and efficiently. Testing by various persons shows that it takes less than 30 seconds to place a target 12 into the frame 18 and clamp it into place. It allows the three-dimensional target 12*a* to retain its natural shape to maintain rigidity. Further, it produces a curve in the two dimensional "waffle" target 12*b* to increase the rigidity of the target 12.

Cycle testing was done with the target 12 completing 14,000 cycles in the target holder assembly 10. It was performed with the target 12 subjected to its normal environmental aspects such as wind, rain, sun, snow, and cold. The target 12 showed slight wear at the point the rear hooks contacted the target 12 and some stress marks where the edge of the clamp contacted the target 12. Neither one of the aspects affected the ability of the cross arm 24 to hold the target 12 or caused the target 12 to become weak and not function properly.

Having thus described exemplary embodiments, it should be noted by those skilled in the art that the within disclosures are exemplary only and that various other alternatives, adaptations, and modifications may be made within the scope of this disclosure as described herein and as described in the appended claims.

What is claimed is:

1. A target holder assembly for interchangeably supporting a two-dimensional target and a three-dimensional target, said target holder assembly comprising:

a base member;

a target holder frame connected to said base member, said target holder frame including a cross arm member connected between two target arms, said target arms connected to opposite sides of said base member;

said cross arm having a base length with a first clamping member extending from a first end of said base length and a second clamping member extending from a second end of said base length opposite said first end, said first clamping member and said second clamping member positioned to engage the three-dimensional target;

said cross arm further having a first receiving groove proximate a junction of said first clamping member and said base length and a second receiving groove proximate a junction of said second clamping member and said base length, said first and second receiving grooves positioned to engage the two-dimensional target;

a protrusion centrally positioned along said base length, said protrusion positioned to engage either the two-dimensional target or the three-dimensional target; and at least one clamping apparatus connected to the base length to engage either the two-dimensional target or the three-dimensional target.

2. The target holder assembly as described in claim 1 further comprising a hit sensor affixed to said base length and in electrical communication with a central processor, said sensor selectively engaging the two-dimensional target or the three-dimensional target.

3. The target holder assembly as described in claim 1 further comprising a shield connected to said base member, said shield positioned between said base member and said cross arm.

4. The target holder assembly as described in claim 1 wherein said first and second clamping members comprise cantilevered jaws.

5. A target holder assembly for interchangeably supporting two-dimensional and three-dimensional targets having central apertures, said assembly comprising:

a base member;

a target holder frame pivotally connected to said base member, said target holder frame including a cross arm member connected between two target arms, said target arms connected to opposite sides of said base member;

said cross arm having a base length with a first clamping member extending from a first end of said base length and a second clamping member extending from a second end of said base length opposite said first end, said first clamping member and said second clamping member positioned to engage the three-dimensional target;

said cross arm further having a first receiving groove proximate a junction of said first clamping member and said base length and a second receiving groove proximate a junction of said second clamping member and said base length, said first and second receiving grooves positioned to engage the two-dimensional target;

a front protrusion positioned along said base length, said protrusion positioned to engage either the two-dimensional target or the three-dimensional target; and clamping means to engage the target, said clamping means connected to the base length to engage either the two-dimensional target or the three-dimensional target.

6. The target holder assembly as described in claim 5 further comprising a hit sensor affixed to said base length and in electrical communication with a central processor, said sensor selectively engaging the two-dimensional target or the three-dimensional target.

7. The target holder assembly as described in claim 6 wherein said first and second clamping members comprise cantilevered jaws.

* * * * *